US012612240B2

(12) United States Patent
Fletcher et al.

(10) Patent No.: US 12,612,240 B2
(45) Date of Patent: Apr. 28, 2026

(54) REUSABLE CRADLE SYSTEM AND METHOD FOR A MATERIAL HANDLING VEHICLE

(71) Applicant: The Raymond Corporation, Greene, NY (US)

(72) Inventors: Eric Fletcher, Canyon Lake, TX (US); Luke Voigt, Saint Hedwig, TX (US)

(73) Assignee: The Raymond Corporation, Greene, NY (US)

( * ) Notice: Subject to any disclaimer, the term of this patent is extended or adjusted under 35 U.S.C. 154(b) by 548 days.

(21) Appl. No.: 18/147,552

(22) Filed: Dec. 28, 2022

(65) Prior Publication Data

US 2023/0202745 A1 Jun. 29, 2023

Related U.S. Application Data

(60) Provisional application No. 63/294,469, filed on Dec. 29, 2021.

(51) Int. Cl.
*B65D 85/00* (2006.01)
*B65D 85/68* (2006.01)

(52) U.S. Cl.
CPC ..... *B65D 85/68* (2013.01)

(58) Field of Classification Search
CPC ..... B60P 3/064; B62B 3/10; F16M 11/42; F16M 3/00; B66F 7/22; B66F 9/07563; B66F 2700/123
USPC ..... 410/3, 5, 66
See application file for complete search history.

(56) References Cited

U.S. PATENT DOCUMENTS

| | | | | |
|---|---|---|---|---|
| 2,567,672 | A | 9/1951 | Lawless | |
| 3,799,379 | A * | 3/1974 | Grether | B66F 9/07563 187/229 |
| 3,809,261 | A * | 5/1974 | Lee | B62B 5/0089 254/8 R |
| 4,813,843 | A | 3/1989 | Gilmour et al. | |
| 4,966,517 | A | 10/1990 | Tune | |
| 10,907,764 | B2 | 2/2021 | Waller et al. | |
| 2008/0199271 | A1* | 8/2008 | Burry | B60P 3/073 410/3 |
| 2009/0142174 | A1* | 6/2009 | Fischer | B66F 9/07563 414/636 |
| 2022/0281501 | A1 | 9/2022 | Hittepole et al. | |

* cited by examiner

FOREIGN PATENT DOCUMENTS

| | | | |
|---|---|---|---|
| DE | 2805142 | A1 | 8/1978 |
| EP | 0218013 | A2 | 4/1987 |

*Primary Examiner* — Stephen T Gordon
(74) *Attorney, Agent, or Firm* — Quarles & Brady LLP

(57) ABSTRACT

A cradle system for a material handling vehicle including two or more elongated legs configured to removably attach to a mast of the material handling vehicle and two or more sleighs configured to removably attach to a base of the material handling vehicle. The cradle system may include a brace configured to removably attach to the legs and a crossmember configured to removably attach to the sleighs. The cradle system has a vehicle configuration in the various components are coupled with a material handling vehicle. With the material handling vehicle in a horizontal position, the attached elongated legs and the attached sleighs support the material handling vehicle above a surface. The cradle system has a storage configuration in which the various components are nested together to minimize the area of the cradle system.

20 Claims, 8 Drawing Sheets

REUSABLE CRADLE SYSTEM AND METHOD FOR A MATERIAL HANDLING VEHICLE

CROSS-REFERENCES TO RELATED APPLICATIONS

This application is based on, claims priority to, and incorporates herein by reference in its entirety U.S. Provisional Patent Application No. 63/294,469 filed Dec. 29, 2021, and entitled "REUSABLE CRADLE SYSTEM AND METHOD FOR A MATERIAL HANDLING VEHICLE."

BACKGROUND

Material handling vehicles, in particular material handling vehicles having an elongated mast, such as order pickers, are transported and/or shipped with a cradle for storage and transport. Material handling vehicles are commonly shipped or transported in a horizontal position in order to provide structural support during transport on a motor vehicle, ship, or airplane. Conventional cradles for shipping material handling vehicles in a horizontal position are, generally, comprised of a substantial quantity of wood pieces and/or other large pieces and necessitate a substantial amount of assembly/disassembly time for two or more workers. Further, conventional shipping cradles must span the length of a particular material handling vehicle, thus, such cradles are as large as a material handling vehicle and may need to be reconfigured to use on other material handling vehicles. As such, conventional shipping cradles for material handling vehicles do not allow for efficient shipping or storage.

In addition, for certain types of vehicles there are training requirements imposed by various government agencies, laws, rules and regulations. For example, OSHA imposes a duty on employers to train and supervise operators of various types of material handling vehicles. Recertification every three years is also required. In certain instances, refresher training in relevant topics shall be provided to the operator when required. In all instances, the operator remains in control of the material handling vehicle during performance of any actions. Further, a warehouse manager remains in control of the fleet of material handling vehicles within the warehouse environment. The training of operators and supervision to be provided by warehouse managers requires among other things proper operational practices including among other things that an operator remain in control of the material handling vehicle, pay attention to the operating environment, and always look in the direction of travel.

BRIEF SUMMARY

The present disclosure relates generally to a transport device for a material handling vehicle, and, more specifically, to a cradle system for a material handling vehicle that can be arranged in a storage configuration.

According to some aspects of the present disclosure, a cradle system for a material handling vehicle is provided. The system can include at least two legs configured to removably attach to a mast of the material handling vehicle, and at least two sleighs configured to removably attach to a base of the material handling vehicle, wherein the at least two legs and the at least two sleighs are configured to support the material handling vehicle above a surface when the material handling vehicle is in a horizontal position, and the at least two legs and the at least to sleighs are configured to combine into a singular unit.

According to some aspects of the present disclosure, a method for rotating a material handling vehicle having a cradle system between an upright position and a horizontal position is provided. The method can include, with the material handling vehicle in the upright position, attaching at least one sleigh of the cradle system to a base of the material handling vehicle, such that a second portion of the sleigh extends along a bottom side of the base and a first portion of the sleigh extends along a rear side of the base, rotating the material handling vehicle toward the horizontal position, such that the first portion of the sleigh contacts a ground surface and the second portion of the sleigh does not contact the ground surface, and attaching a first end of a first leg and a first end of a second leg of the cradle system to a mast of the material handling vehicle, such that the second end of the first leg and the second end of the second leg contact the ground surface when the material handling vehicle is in the horizontal position.

According to some aspects of the present disclosure, a method for storing a cradle system for a material handling vehicle is provided. The method can include positioning a first leg of the cradle system on a second leg of the cradle system, fastening the first leg to the second leg, positioning a sleigh of the cradle system on the first leg, and fastening the sleigh to the first leg.

The foregoing and other aspects and advantages of the disclosure will appear from the following description. In the description, reference is made to the accompanying drawings which form a part hereof, and in which there is shown by way of illustration a preferred configuration of the disclosure. Such configuration does not necessarily represent the full scope of the disclosure, however, and reference is made therefore to the claims and herein for interpreting the scope of the disclosure.

BRIEF DESCRIPTION OF DRAWINGS

The invention will be better understood and features, aspects and advantages other than those set forth above will become apparent when consideration is given to the following detailed description thereof. Such detailed description makes reference to the following drawings.

DETAILED DESCRIPTION

Figure 2:
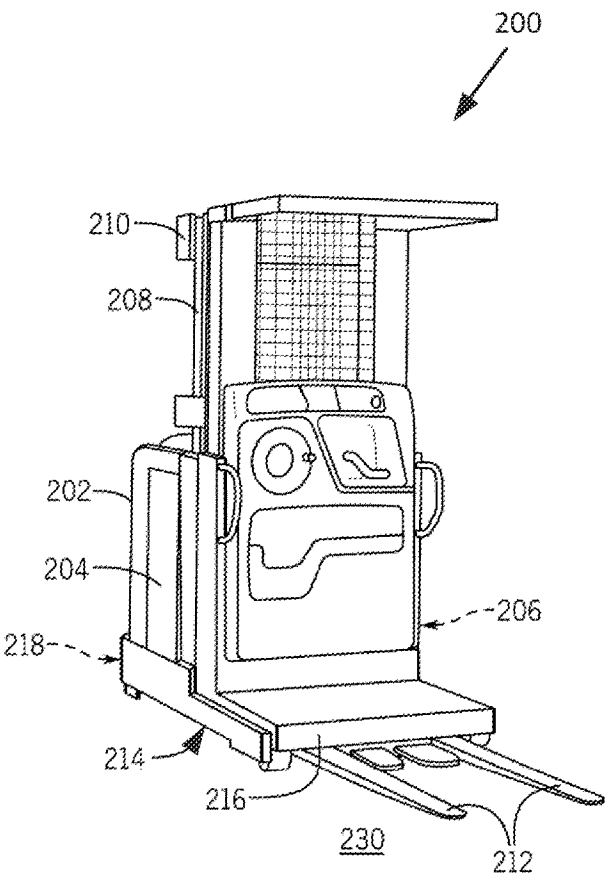
FIG. 2 illustrates a material handling vehicle in the form of an order picker in an upright position, according to various aspects of the present disclosure.

Before any aspect of the present disclosure are explained in detail, it is to be understood that the present disclosure is not limited in its application to the details of construction and the arrangement of components set forth in the following description or illustrated in the following drawings. The present disclosure is capable of other configurations and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," "contact," and "coupled" and variations thereof are used broadly and encompass both direct and indirect mountings, connections, supports, and couplings. Further, "connected" and "coupled" are not restricted to physical or mechanical connections or couplings.

It is also to be understood that any reference to an element herein using a designation such as "first," "second," and so forth does not limit the quantity or order of those elements, unless such limitation is explicitly stated. Rather, these designations may be used herein as a convenient method of distinguishing between two or more elements or instances of an element. Thus, a reference to first and second elements does not mean that only two elements may be employed there or that the first element must precede the second element in some manner.

The following discussion is presented to enable a person skilled in the art to make and use aspects of the present disclosure. Various modifications to the illustrated configurations will be readily apparent to those skilled in the art, and the generic principles herein can be applied to other configurations and applications without departing from aspects of the present disclosure. Thus, aspects of the present disclosure are not intended to be limited to configurations shown, but are to be accorded the widest scope consistent with the principles and features disclosed herein. The following detailed description is to be read with reference to the figures, in which like elements in different figures have like reference numerals. The figures, which are not necessarily to scale, depict selected configurations and are not intended to limit the scope of the present disclosure. Skilled artisans will recognize the non-limiting examples provided herein have many useful alternatives and fall within the scope of the present disclosure.

It should be appreciated that material handling vehicles are designed in a variety of classes and configurations to perform a variety of tasks. It will be apparent to those of skill in the art that the present disclosure is not limited to any specific material handling vehicle, and can also be provided with various other types of material handling vehicle classes and configurations, including for example, lift trucks, fork-lift trucks, reach trucks, SWING REACH® vehicles, turret trucks, side loader trucks, counterbalanced lift trucks, pallet stacker trucks, order pickers, transtackers, tow tractors, and man-up trucks, and can be commonly found in warehouses, factories, shipping yards, and, generally, wherever pallets, large packages, and/or loads of goods can be required to be transported from place to place. The various systems and methods disclosed herein are suitable for any of operator controlled, pedestrian controlled, remotely controlled, and autonomously controlled material handling vehicles. Further, the present disclosure is not limited to material handling vehicles applications. Rather, the present disclosure may be provided for other types of vehicles or other types of devices for transport and shipping purposes, such as automobiles, busses, trains, tractor-trailers, farm vehicles, factory vehicles, and the like.

Generally, the present disclosure provides a cradle system for transporting a material handling vehicle ("MHV") that enables assembly/disassembly in substantially less time compared to conventional shipping cradles for MHVs. For example, the cradle system may include a plurality of components that are comprised of a durable material that is suitable for repeated use while adequately supporting the weight of a MHV, such as a metallic substance having high compression strength. In some embodiments, one or more components of the cradle system may comprise steel. The plurality of components of the cradle system may be configured to removably attach to the MHV such that the time to assemble and disassemble the cradle system is minimized and reduced when compared to conventional cradle assemblies. In some non-limiting configurations, the cradle system may be used on various types of MHVs having different lengths and/or widths without modifications to the cradle system. In some non-limiting configurations, the components of the cradle system may be configured to attach to one another when uncoupled from the MHV such that the cradle system has a minimal footprint when stored.

As used herein, a "storage configuration" of the cradle system refers to a configuration of the cradle system where the components are not coupled with the MHV and are combined together, for example coupled to one another and forming a singular unit for storage of the cradle system, transport of the cradle system, carrying of the cradle system, or the like. As used herein, a "vehicle configuration" of the cradle system refers to a configuration of the cradle system where the components are coupled with the MHV such that the cradle system can support the MHV when the MHV is laid on its side (e.g., in a horizontal position).

Figure 1:
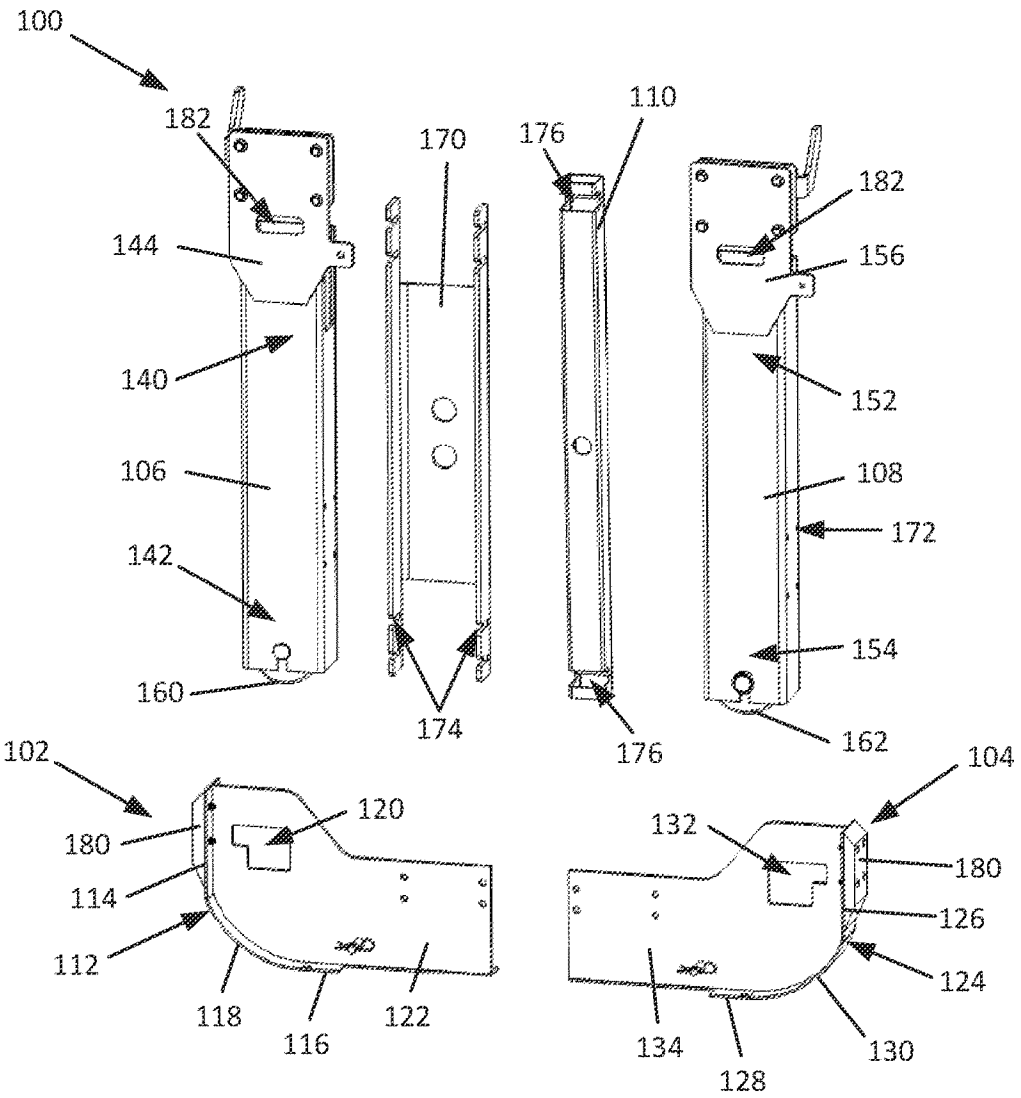
FIG. 1 illustrates a cradle system, according to various aspects of the present disclosure.

Referring to FIG. 1, a non-limiting example cradle system 100 is shown. The cradle system 100 may comprise a first sleigh 102, a second sleigh 104, a first elongated leg 106, a second elongated leg 108, a crossmember 110, and a brace 170. As described above, the cradle may comprise one or more materials, for example square metal tubing for the legs 106, 108 and crossmember 110, and metal plate (e.g., of one or more thicknesses) for other components such as brackets, tabs, and braces to be describe in more detail below. The metal may comprise steel, iron, aluminum, or the like.

Referring to FIG. 2, a non-limiting example material handling vehicle 200 in the form of an order picker in an upright position is shown. The material handing vehicle 200 may have a base 202 with a first side 204 and a second side 206 opposite the first side, an elongated mast 208 that is extendable from the base 202 to a top portion 210 of the mast 208, and two or more forks 212 that are removably attached to a bottom side 214 of the base 202 at a front side 216, opposite a back side 218, of the base 202. The material handling vehicle 200 may operate on a ground surface 230, for example a warehouse floor, concrete slab, or the like.

Figure 4:
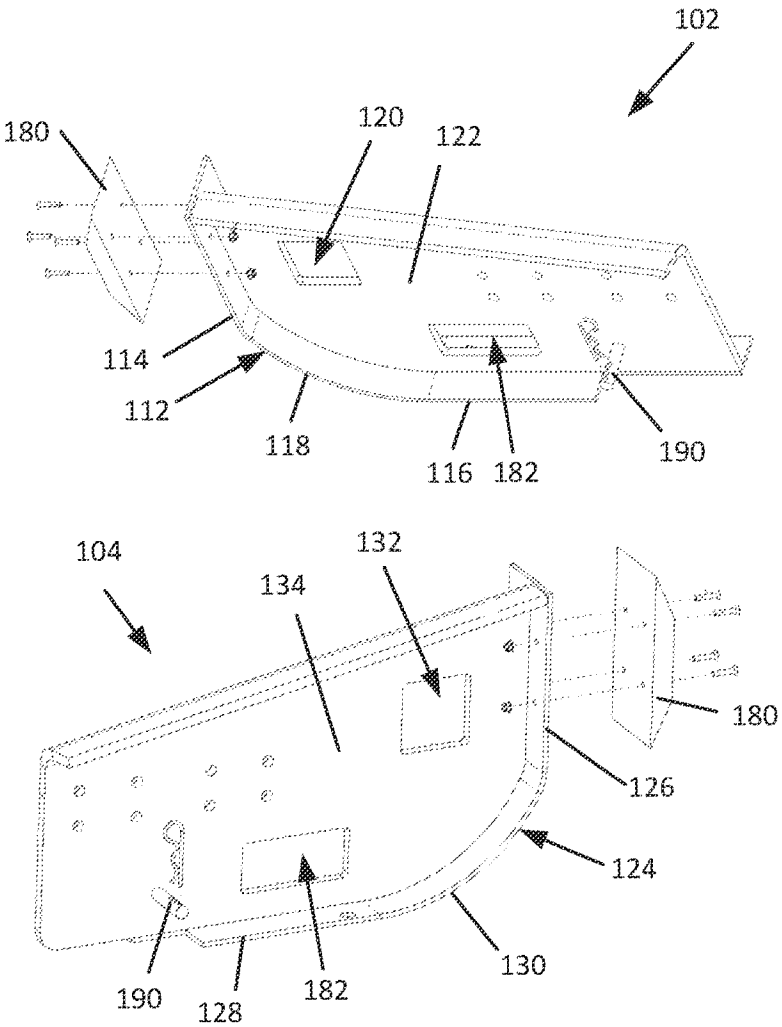
FIG. 4 is a detailed view of the sleighs of the cradle system, according to various aspects of the present disclosure.

Referring to FIGS. 1 and 4, the first sleigh 102 has an outer surface 112 that includes a first portion 114, a second portion 116 that is perpendicular to the first portion 114, and a third portion 118 defining a curved shape having a radius that is disposed between the first and the second portions 114, 116. An opening 120 is disposed through a body 122 of the first sleigh 102. The first and second sleighs 102, 104 may have the same dimensions and configuration but mirrored relative to each other. For example, in some embodiments, the second sleigh 104 has an outer surface 124 that includes a first portion 126, a second portion 128 that is perpendicular to the first portion 126, and a third portion 130 defining a curved shape having a radius that is disposed between the first and the second portions 126, 128. An opening 132 is disposed through a body 134 of the second sleigh 104. In the illustrated example configuration, the third portions 118, 130 of the first and the second sleighs 102, 104 have the same radius or curvature.

The cradle system 100 may include a pad 180 disposed on the first portions 114, 126 of the first and second sleighs 102, 104, respectively. The pads 180 are configured to contact the ground surface 230 when the material handling vehicle 200 with the cradle system 300 attached is in the horizontal position (for example, see FIG. 8). The pads 180 may comprise a material that reduces friction with the ground surface 230 while providing sufficient friction to prevent sliding in transit, such as, for example, nylon. Thus, the pads 180 can provide a reduced friction when the material handling vehicle 200 coupled with the cradle system 100 is positioned in the horizontal position and is moved laterally about the ground surface 230.

Figure 5:
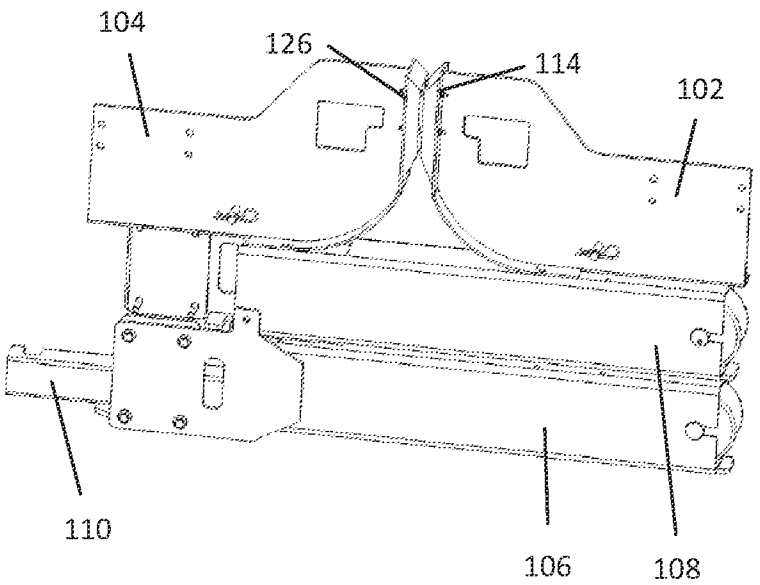
FIG. 5 illustrates the cradle system in a storage configuration, according to various aspects of the present disclosure.

The crossmember 110 is configured to be received by the openings 120, 132 disposed in the bodies 122, 134 of the first and the second sleighs 102, 104, respectively. In the illustrated example of FIG. 1, the crossmember 110 is comprised of the same material as the sleighs 102, 104. In other embodiments, the crossmember 110 may comprise wood or other material noted above. In some embodiments, the crossmember 110 may have a cross section (width and depth, with length being the longest dimension of the cross-member 110) having dimensions small enough to allow the crossmember 110 to be slidably inserted into one of the legs 106, 108 in a storage configuration (for example, as shown in FIG. 5).

Figure 8:
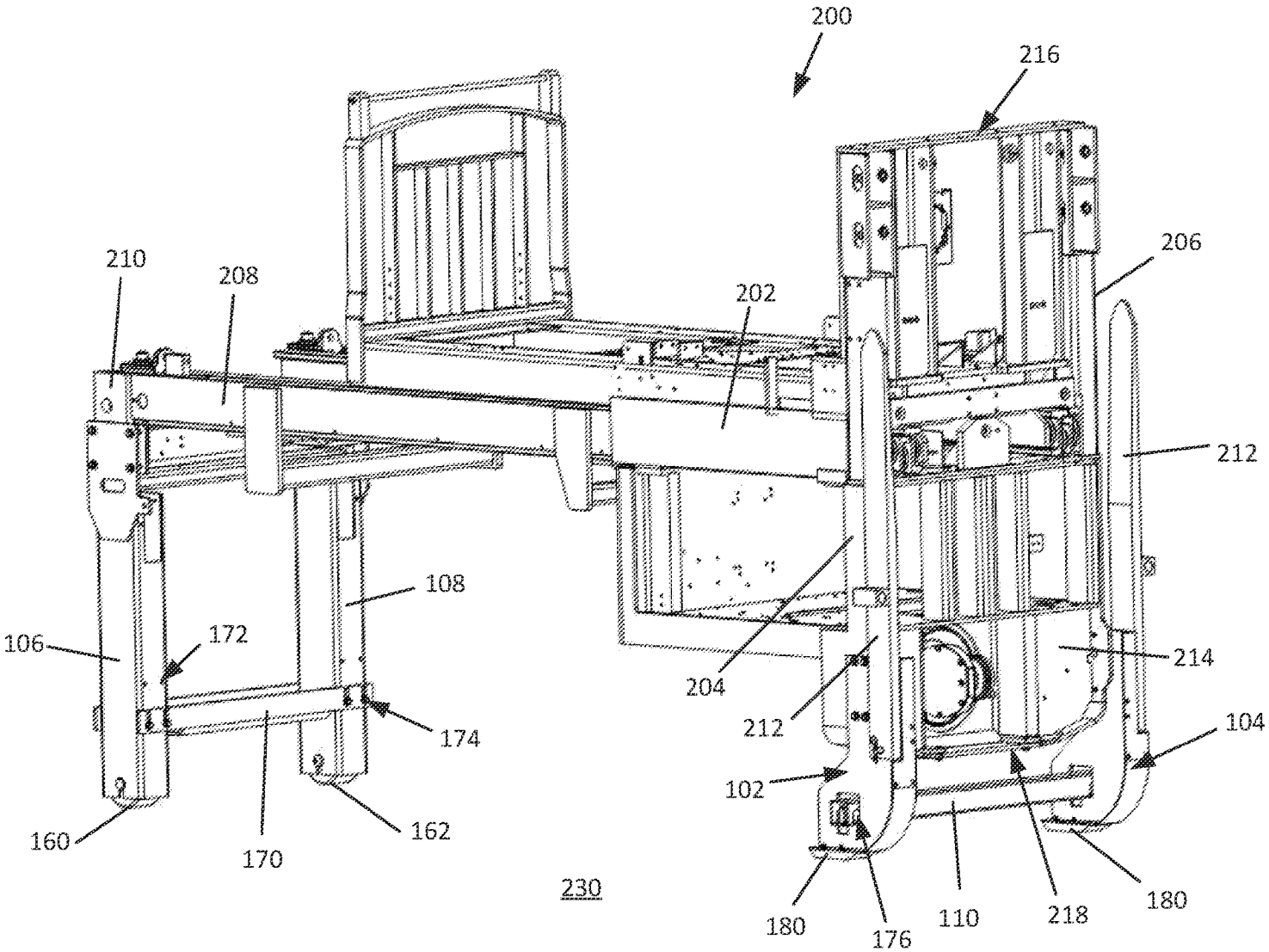
FIG. 8 illustrates a material handling vehicle, coupled with a cradle system, in a horizontal position, according to various aspects of the present disclosure.

In some embodiments, the crossmember 110 may be configured to be securely received within the openings 120, 132 of the first sleigh 102 and second sleigh 104, respectively, when the first and second sleighs 102, 104 are attached to the material handling vehicle 200 (e.g., in a vehicle configuration). The crossmember 110 may include a groove 176 disposed on each end of the crossmember 110, wherein each groove 176 is configured to receive a lip of the openings 120, 132 such that the crossmember 110 is prevented from moving laterally within the openings 120, 132 (for example, as shown in FIG. 8). In some embodiments, the crossmember 110 can be removably attached or otherwise secured within the openings 120, 132 by other known fastening methods.

Figure 3:
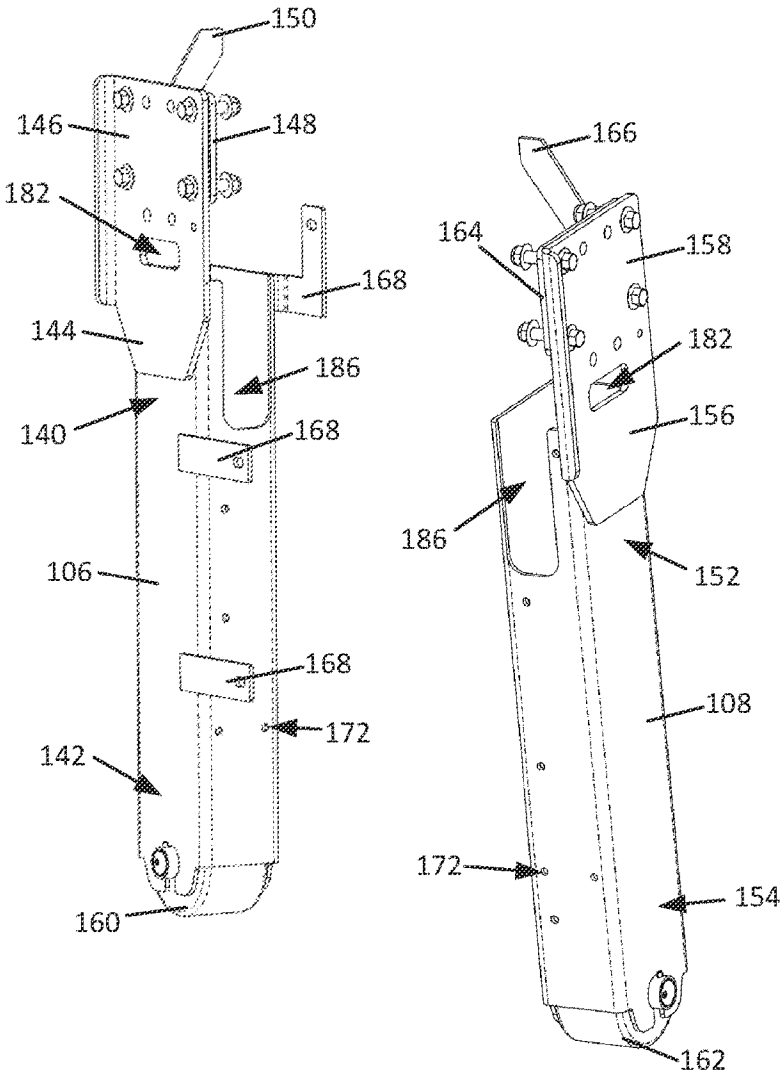
FIG. 3 is a detailed view of the legs of the cradle system, according to various aspects of the present disclosure.

Referring to FIGS. 1 and 3, the first leg 106 has a first end 140 and a second end 142, opposite the first end 140. In some embodiments, a bracket 144 is included at the first end 140 of the first leg 106. The bracket 144 may include a first plate 146, for example integrally formed with or permanently attached to the first end 140 of the first leg 106, and a second plate 148 configured to removably attach to the first plate 146 of the bracket 144, for example using a bolt-style fastener. In some embodiments, the second plate 148 of the bracket 144 includes an extension piece 150 that extends from an end of the second plate 148 and has a surface that is perpendicular to the second plate 148.

In some embodiments, the first and second legs 106, 108 have the same dimensions and configuration but mirrored relative to each other. For example, the second leg 108 has a first end 152 and a second end 154, opposite the first end 152. A bracket 156 may be included at the first end 152 of the second leg 108. Similar to the bracket 144 of the first leg 106, the bracket 156 of the second leg 108 may include a first plate 158, for example integrally formed with or permanently attached to the first end 152 of the second leg 108, and a second plate 164 configured to removably attach to the first plate 158 of the bracket 156 of the second leg 108. In some embodiments, similar to the second plate 148 of the first attachment bracket 144 of the first leg 106, the second plate 164 of the bracket 156 of the second leg 108 includes an extension piece 166 that extends from an end of the second plate 164 and has a surface that is perpendicular to the second plate 164 of the bracket 156. In some embodiments, only one of the brackets 144, 156 includes the extension piece 150, 166 (respectively). In some embodiments, one or more legs 106, 108 may be hollow or otherwise include a cavity 186. The cavity 186 may be configured to receive the crossmember 110 in a storage configuration.

In some embodiments, the brackets 144, 156 at the second ends 140, 152 of the first and second legs 106, 108, respectively, comprise a handle feature configured to facilitate carrying or assembly of the legs 106, 108. For example, the brackets 144, 156 may include a slot 182 extending through the first plates 146, 158. The slots 182 may be configured to provide a carrying handle for an assembler of the cradle system 100, for example to facilitate positioning of the legs 106, 108 about the material handling vehicle 200. In some embodiments, the first and second sleighs 102, 104 may include slots similar to the slots 182 of the first and second legs 106, 108. In some embodiments, the handle feature may comprise a D-ring affixed to the brackets 144, 156 and/or bodies 122, 134 of the first and second sleighs 102, 104.

In some non-limiting examples, the second ends 142, 154 of the first and the second legs 106, 108 include rollers 160, 162, respectively. In some such non-limiting examples, when the material handling vehicle 200 with the cradle system 100 attached is in the horizontal position, for example as shown in FIG. 8, the material handling vehicle 200 is moveable along the ground surface 230 by lifting the base 202 of the material handling vehicle 200 with an auxiliary vehicle (not shown) having forks disposed below the crossmember 110, such that the outer surfaces 112, 124 of the sleighs 102, 104 do not contact the ground surface 230, and pushing the material handling vehicle 200 with the auxiliary vehicle such that the rollers 160, 162 of the legs 106, 108 roll along the ground surface 230. In some non-limiting examples, the combination of the rollers 160, 162 and pads 180 may allow the material handling vehicle 200 to be moved (e.g., pushed by an auxiliary vehicle) without having to lift the base 202 of the material handling vehicle 200 off the ground surface 230. The material handling vehicle 200 may move by action of the pads 180 sliding and the rollers 160, 162 rolling along the ground surface 230.

Figure 9:
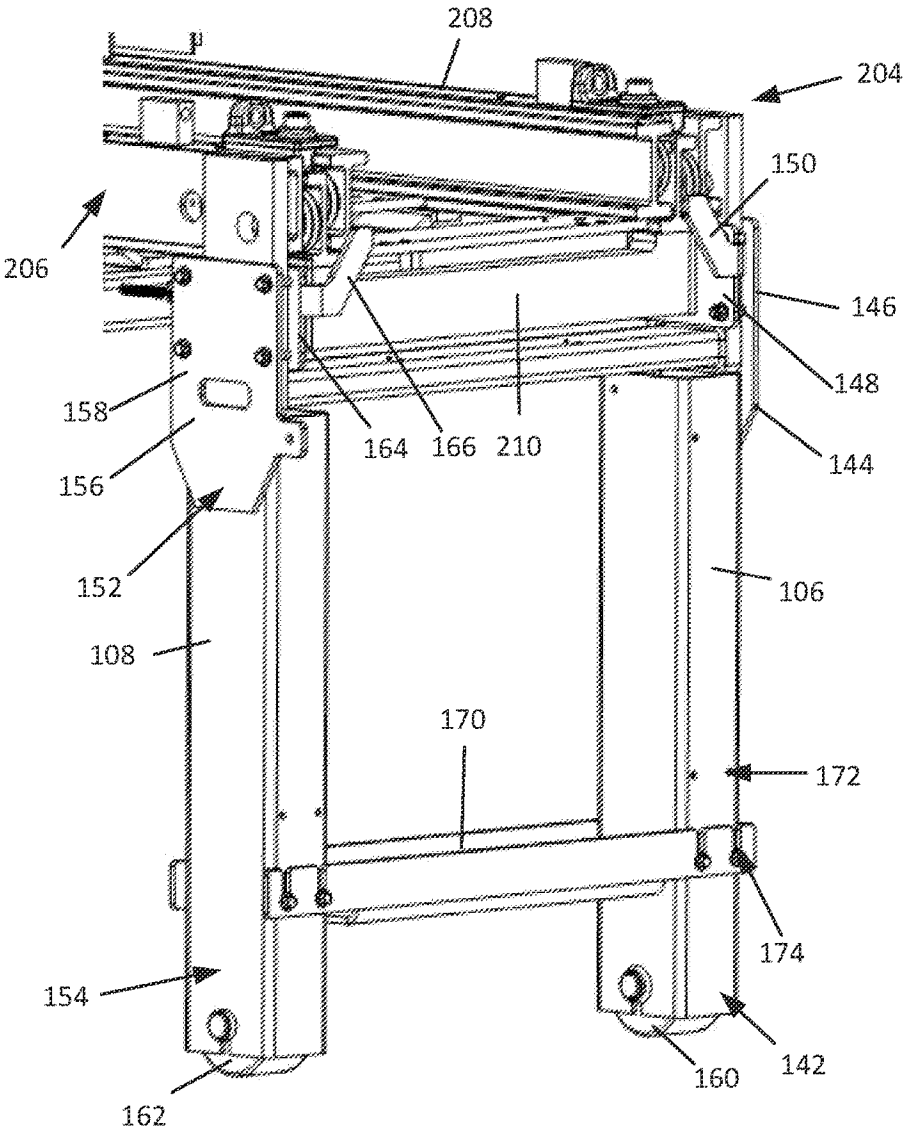
FIG. 9 is a detailed view the legs of the cradle system coupled with the material handling vehicle, according to various aspects of the present disclosure.

Referring again to FIG. 1, in some embodiments, the cradle system 100 may include a brace 170 configured to be removably attached to the first leg 106 and the second leg 108 when the first and second legs 106, 108 are attached to the material handling vehicle 200, for example as shown in FIG. 9. The first and second legs 106, 108 may include a plurality of fastener holes 172 that are configured to receive a plurality of fasteners that are received by a plurality of corresponding grooves 174 of the brace 170. The plurality of fastener holes 172 may be disposed on the two surfaces of the legs 106, 108 that align with a rolling direction of the rollers 160, 162. Referring briefly to FIG. 9, once the fasteners are received by the grooves 174, the fasteners can be tightened to removably secure the second cross member 170 to the first and second legs 106, 108. In some embodiments, the brace 170 can be removably attached to the first and second legs 106, 108 by other known fastening means. In some embodiments, the brace 170 can comprise a plurality of braces configured to be removably attached to different locations at or between the first ends 140, 152 and the second ends 142, 154 of the first and second legs 106, 108, respectively.

When the cradle system 100 is assembled on the material handling vehicle 200, the brace 170 improves the strength of the first and second legs 106, 108 by reducing movement of the legs 106, 108 relative to one another. For example, if the material handling vehicle 200 in the horizontal position (e.g., as shown in FIG. 8) is moved perpendicular to the rolling direction of the rollers 160, 162 of the legs 106, 108, the second cross member 170 prevents the legs 106, 108 from shifting relative to the mast 208 while the rollers 160, 162 slide across the ground surface 230. The brace 170 may also provide stiffness and/or strength to the legs 106, 108 while the material handling vehicle 200 is in transport.

Figure 6:
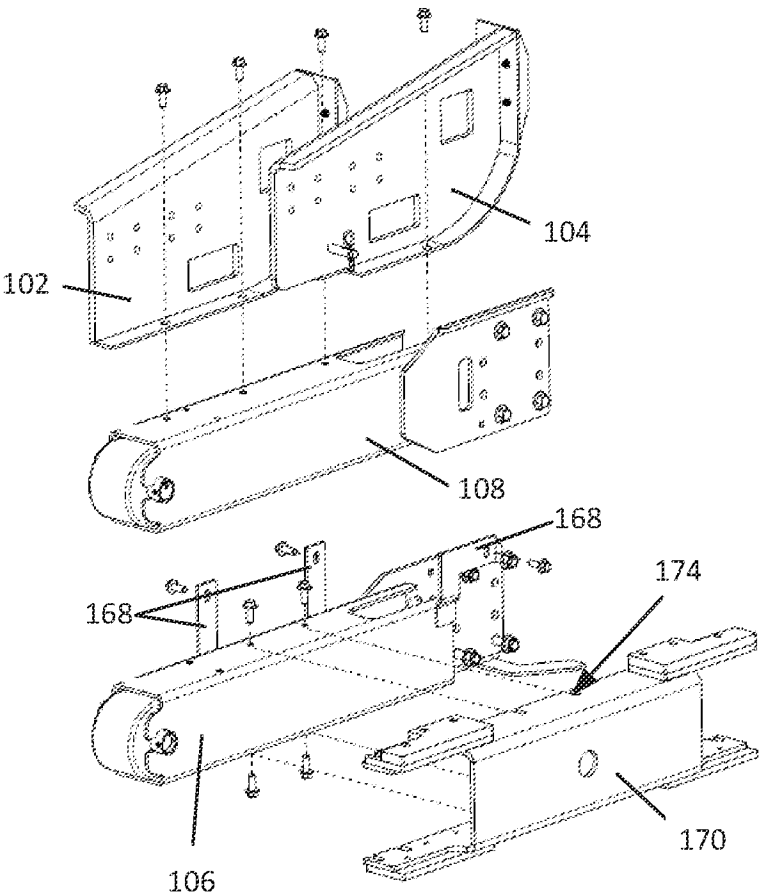
FIG. 6 is an exploded-view diagram of the cradle system in another storage configuration, according to various aspects of the present disclosure.

Referring to FIGS. 5 and 6, in some non-limiting configurations, the cradle system 100 is configured such that components of the cradle system 100 may be attached to each other in an assembled configuration that minimizes the area of the cradle system 100 when the cradle system 100 is not in use (a storage configuration). For example, referring to FIG. 5, in some exemplary embodiments, the first and second legs 106, 108 are stacked on each other with the crossmember 110 disposed between the first and second legs 106, 108 or inserted into one of the legs 106, 108 (e.g., in a cavity 186). For example, the crossmember 110 is shown inserted into the cavity 186 of the first leg 106 in FIG. 2. The first and second sleighs 102, 104 are stacked on top of the first and second legs 106, 108, for example with the second portions 116, 128 of the outer surfaces 112, 124 of the first and second sleighs 102, 104, respectively, contacting one of the legs 106, 108. In some such embodiments, the first portions 114, 126 of the outer surfaces 112, 124 of the first and second sleighs 102, 104 may be in contact with or otherwise facing each other, may each face outward, or may each face the same direction.

Referring to FIG. 6, in some embodiments, the brace 170 may be fastened to one of the legs 106, 108 before the legs are stacked on each other. For example, the first leg 106 may be received within the brace 170 prior to the second leg 108 being placed on top of the combination of the first leg 106 and brace 170. In some such embodiments, the crossmember 110 may be inserted into one of the legs 106, 108 as described above, or may be kept separate. The sleighs 102, 104 may be placed on top of one of the legs 106, 108 as described above.

In some embodiments, the sleighs 102, 104 and the legs 106, 108 include fastener holes or other attachment mechanisms such that the sleighs 102, 104, legs 106, 108, crossmember 110, and/or brace 170 can be combined together, for example coupled to each other, such that the cradle system 100 can be carried, stored, transported, and the like as a singular unit (or singular piece) or an approximately singular unit (i.e., with the crossmember 110 and/or brace 170 separate). In some embodiments, said fastener holes may comprise the same fastener holes (e.g., fastener holes 172) used to couple the various components of the cradle system 100 to the MHV and/or to crossmember 110 or brace 170. In some embodiments, for example referring to FIG. 3, one or more of the legs 106, 108 may include one or more tabs 168 to provide a coupling interface to one or more other components of the cradle system 100, for example the other leg 106, 108. The tabs 168 may comprise one or more fastener holes or other attachment mechanisms.

Figure 7:
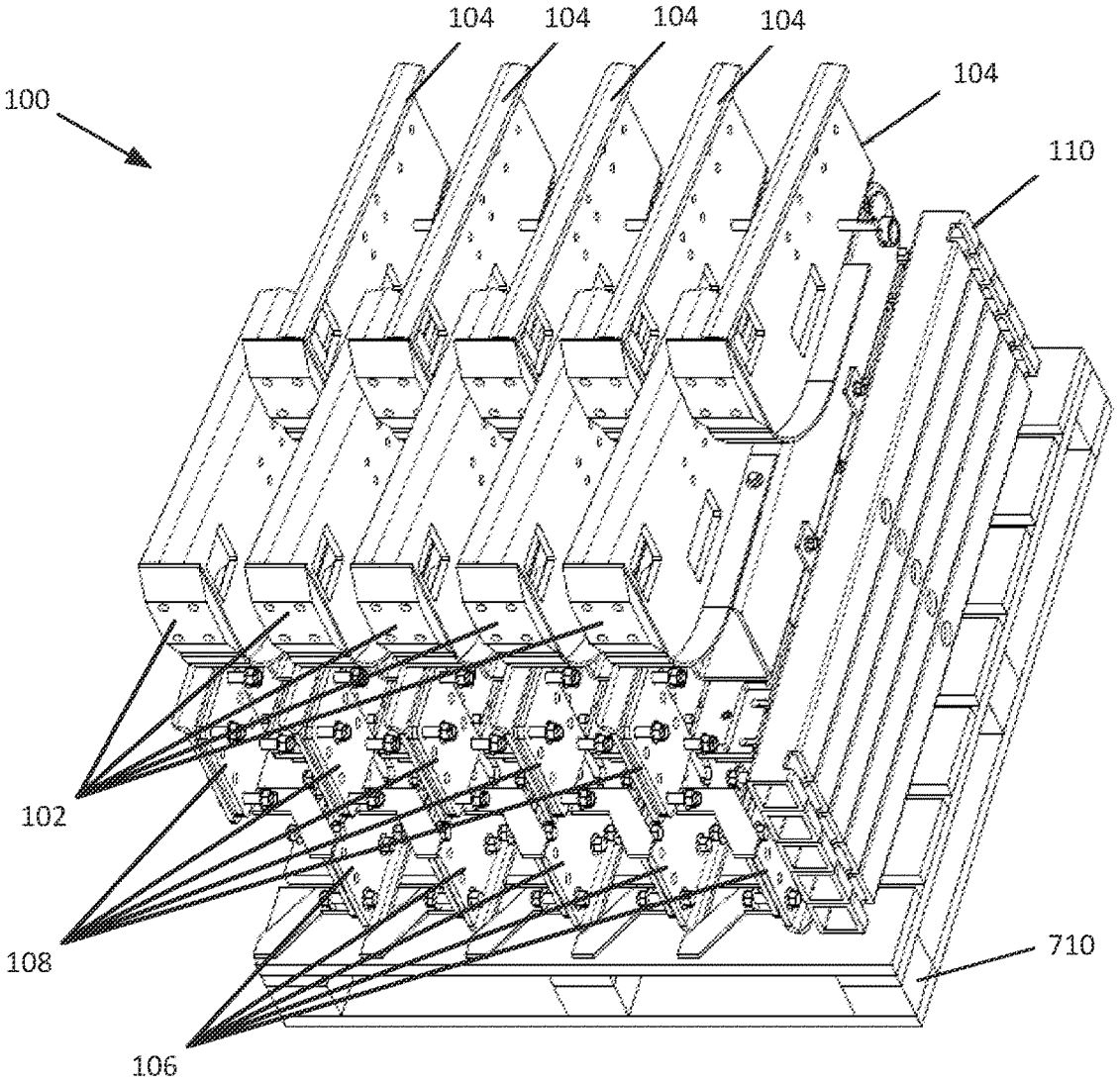
FIG. 7 is a perspective view of multiple cradle systems stored on a single palette, according to various aspects of the present disclosure.

Advantageously, the cradle system 100 arranged in a storage configuration occupies a minimal area such that multiple cradle systems 100 can be transported in the same box, on the same palette, or the like. For example, FIG. 7 illustrates five cradle systems 100 in a storage configuration arranged on a standard palette 710 (e.g., measuring 48 inches by 40 inches). As illustrated in FIG. 7, the storage configuration may comprise the braces 170 fastened to the legs 106, 108 (e.g., as shown in FIG. 6) and the crossmembers 110 stacked separately.

Figure 10:
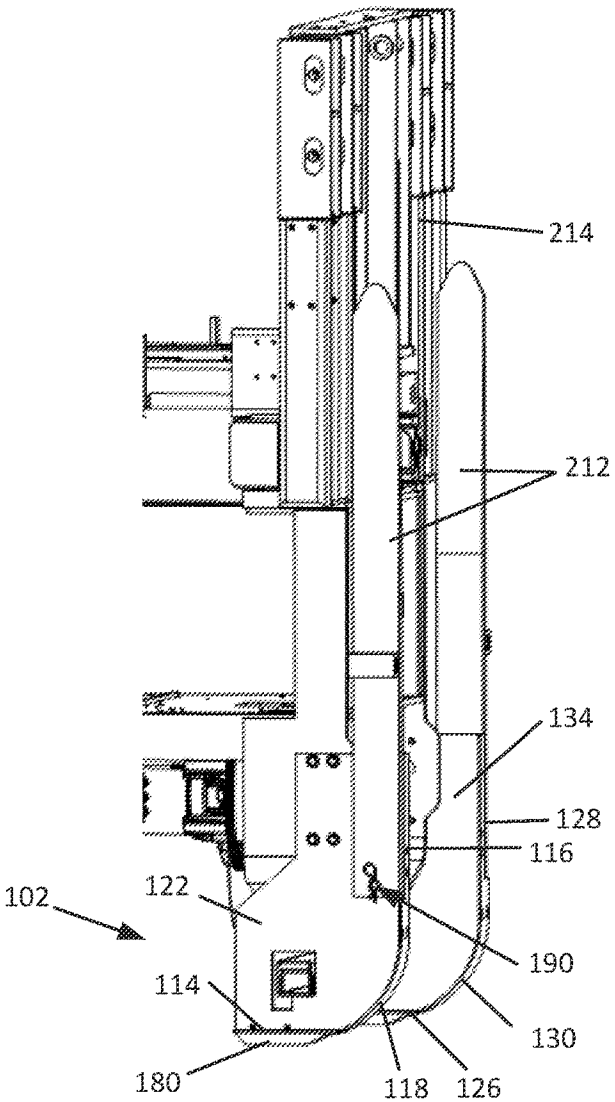
FIG. 10 is a detailed view of the sleighs of the cradle system coupled with the material handling vehicle, according to various aspects of the present disclosure.

Referring to FIGS. 8-10, when the cradle system 100 is attached to the material handling vehicle 200 in a vehicle configuration, the cradle system 100 may support the material handling vehicle 200 in a horizontal position. Referring specifically to FIGS. 8 and 10, the first sleigh 102 may be attached (e.g., via the body 122 of the first sleigh) to the first side 204 of the base 202 of the material handling vehicle 200, such that the first portion 114 of the outer surface 112 of the first sleigh 102 is in contact with (via pad 180 in some embodiments) a ground surface 230 and the second portion 116 of the outer surface 112 is disposed adjacent to the bottom side 214 of the base 202. The sleigh may be attached at the back side 218 on the first side 204 of the material handling vehicle 200. Likewise, the body 134 of the second sleigh 104 may be attached to the second side 206 of the base 202 of the material handling vehicle 200 (for example, at the back side 218), such that the first portion 126 of the outer surface 124 of the second sleigh 104 is in contact with (via pad 180 in some embodiments) a ground surface 230 and the second portion 128 of the outer surface 124 is disposed adjacent to the bottom side 214 of the base 202.

Referring to FIG. 8, the cross member 110 is disposed through the openings 120, 132 of the bodies 122, 134 of the first and the second sleighs 102, 104, such that the cross member 110 is adjacent to the back side 218 of the base 202 of the material handling vehicle 200. In some embodiments, the crossmember 110 may include one or more openings or indents configured to receive one or more forks of an auxiliary vehicle, for example to facilitate movement of the material handling vehicle 200 by the auxiliary vehicle as described above.

Referring to FIGS. 8 and 9, the bracket 144 of the first leg 106 is attached to the top portion 210 of the mast 208 at the first side 204 of the material handling vehicle 200 and the second end 142 of the first leg 106 is in contact with the ground surface 230 (e.g., via roller 160). Likewise, the bracket 156 of the second leg 108 is attached to the top portion 210 of the mast 208 at the second side 206 of the material handling vehicle 200 and the second end 154 of the second leg 108 is in contact with the ground surface 230 (e.g., via roller 162). As shown in FIG. 8, the first and the second legs 106, 108 may have a length such that the mast 208 of the material handling vehicle 200 is approximately level in the horizontal position.

Referring now to FIG. 9, the bracket 156 of the second leg 108 is shown attached to the mast 208 of the material handling vehicle 200 in greater detail. The top portion 210 of the mast 208 of the material handling vehicle 200 is in contact with the first end 152 of the second leg 108. The first plate 158 of the bracket 156 contacts the mast 208 on the second side 206 of the material handling vehicle 200 and the second plate 164 of the bracket 156 is disposed within the mast 208 and fastened to the first plate 158 of the bracket 156, for example by bolt-style fasteners. In some embodiments, the extension piece 166 of the second plate 164 of the bracket 156 is configured to retain a moveable portion of the mast 208. For example, the extension piece 166 may be in contact with or almost in contact with a moveable piece of the mast 208 of the material handling vehicle 200, such that the moveable piece of the mast 208 is not free to slide out of the top portion 210 of mast 208.

Likewise, the first plate 146 of the bracket 144 of the first leg 106 contacts the mast 208 of the first side 204 of the material handling vehicle 200 and the second plate 148 of the bracket 144 is disposed within the mast 208 and fastened to the first plate 146 of the bracket 144. In some embodiments, the extension piece 150 of the second plate 148 of the bracket 144 is configured to retain a moveable portion of the mast 208. For example, the extension piece 150 may be in contact with or almost in contact with a moveable piece of the mast 208 of the material handling vehicle 200, such that the moveable piece of the mast 208 is not free to slide out of the top portion 210 of mast 208. In some embodiments, only one of the legs 106, 108 includes an extension piece 150, 166. The present disclosure is not limited to the brackets 144, 156 described herein for coupling the legs 106, 108 to the mast 208. Any suitable apparatus may be used to couple the legs 106, 108 with the mast 208. In some embodiments, the cradle system 100 includes one or more additional legs that are configured to removably attach to an additional location of the top portion 210 of the mast 208 or to locations proximate to middle or lower portions of the mast 208.

Referring now to FIGS. 4 and 10, in some non-limiting examples, each of the bodies 122, 134 of the first and the second sleighs 102, 104 are configured to receive one of the detached forks 212 of the material handling vehicle 200. In some embodiments, the bodies 122, 134 of the first and second sleighs 102, 104 may include a post 190 configured to receive a cotter pin or other securing member. A first end of the fork 212 may include a hole through which the post 190 may be placed, and the fork 212 may then be secured by the cotter pin or other securing member to the respective sleigh 102, 104. In some embodiments, the fork 212 may be further secured to the material handling vehicle 200 toward a second end of the fork, for example by straps holding the fork 212 tight to the material handling vehicle 200. This configuration may allow transport of the forks with the material handling vehicle, rather than separating the forks from the material handling vehicle to enable transport.

Figure 11:
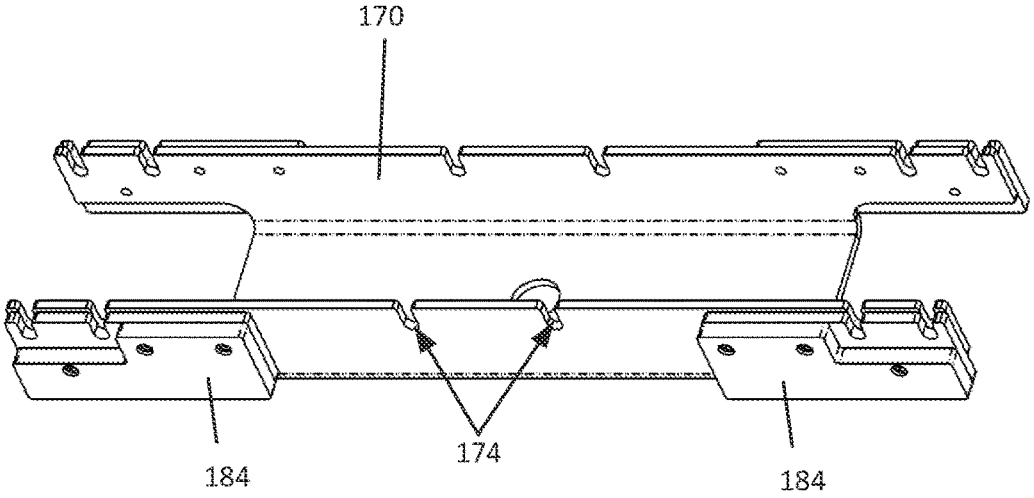
FIG. 11 is a detailed view of a brace of the cradle system, according to various aspects of the present disclosure.
Figure 12:
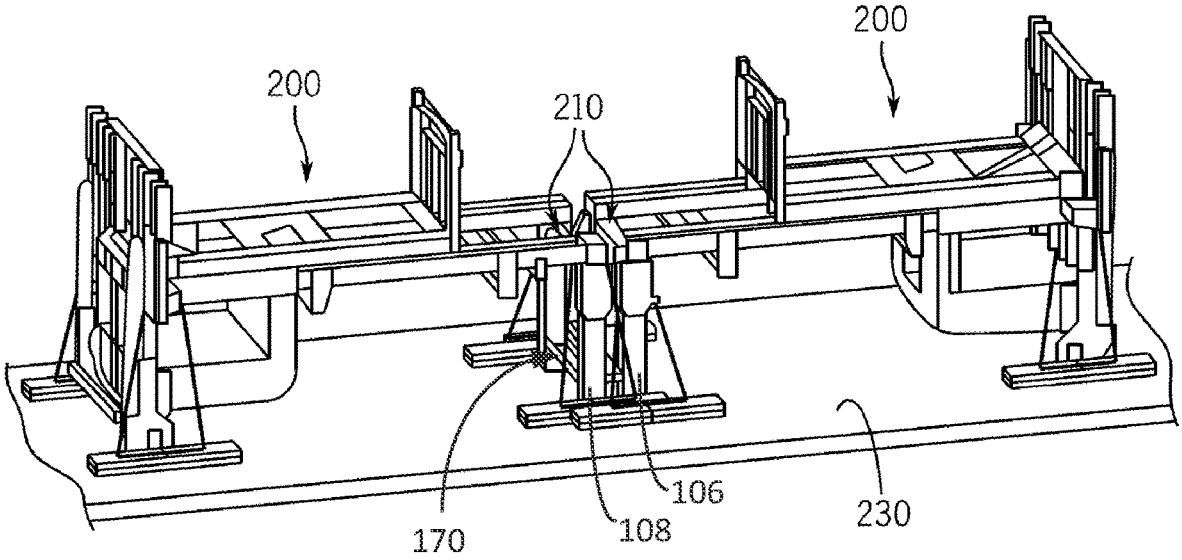
FIG. 12 illustrates two material handling vehicles coupled with cradle systems and configured for transport, according to various aspects of the present disclosure.

Referring to FIGS. 11 and 12, in some embodiments the brace 170 may include one or more pads 184 arranged on a surface of the brace 170 that is facing upward from the top portion of the mast 210 (with reference to the material handling vehicle 200 in a vertical position) when the cradle system 100 is in a vehicle configuration. The pad 184 may allow multiple material handling vehicles 200 having attached cradle systems 100 to be blocked together mast-to-mast for transport without damaging each other. For example, referring to FIG. 12, two material handling vehicles 200 may be arranged for transport by facing the top portion of the masts 210 toward each other. The pads 184 of each brace 170 attached to each material handling vehicle 200 may contact each other and may prevent other portions of the material handling vehicles 200 from contacting in an undesirable manner. In some embodiments, the pads 184 may comprise a material that is durable, and in some embodiments has reduced friction to facilitate abutment of a first material handling vehicle 200 against a second material handling vehicle 200, such as, for example nylon or metal.

In the non-limiting examples described with reference to FIGS. 1-6 and 8, the material handling vehicle 200 having the attached cradle system 100 is rotatable from the horizontal position, as shown in FIG. 8, to an upright position, as shown in FIG. 2, and vice versa. The material handling vehicle 200 may be rotated to the upright position about the outer surfaces 112, 124 of the sleighs 102, 104 by pulling, for example using an auxiliary vehicle, the top portion 210 of the mast 208 upwards and away from the ground surface 230. In the horizontal position, the first portions 114, 126 of the outer surfaces 112, 124 of the sleighs 102, 104, respectively, contact the ground surface 230. While rotating the material handling vehicle 200 toward the upright position, the third portions 118, 130 of the outer surfaces 112, 124 of the sleighs 102, 104, respectively, contact the ground surface 230. Once rotated to the upright position, the second portions 116, 128 of the outer surfaces 112, 124 of the sleighs 102, 104, respectively, contact the ground surface 230.

In some implementations, devices or systems disclosed herein can be utilized or configured for operation using methods embodying aspects of the invention. Correspondingly, description herein of particular features, capabilities, or intended purposes of a device or system is generally intended to inherently include disclosure of a method of using such features for the intended purposes, a method implementing such capabilities, and a method of configuring disclosed (or otherwise known) components to support these purposes or capabilities. Similarly, unless otherwise indicated or limited, discussion herein of any method of manufacturing or using a particular device or system, including configuring the device or system for operation, is intended to inherently include disclosure, as embodiments of the invention, of the utilized features and implemented capabilities of such device or system.

Figure 13:
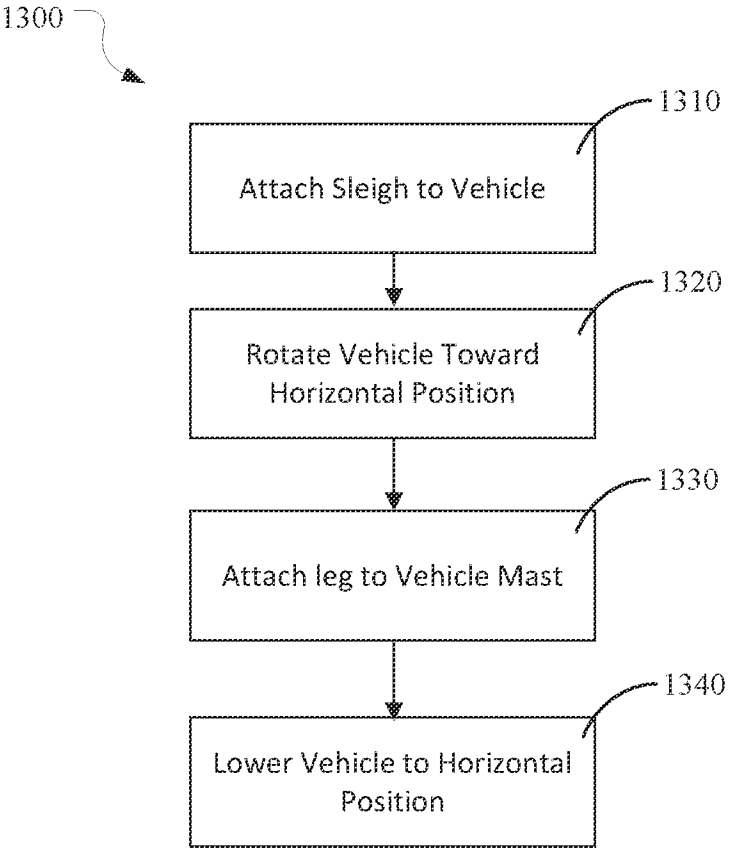
FIG. 13 illustrates a method for utilizing a cradle system to position a material handling, according to various aspects of the present disclosure.

Correspondingly, some embodiments can include a method for rotating a material handling vehicle 200 having a cradle system 100 between an upright position and a horizontal position. As one example, shown in FIG. 13, a method for rotating a material handling vehicle 1300 can include attaching 1310 at least one sleigh of a cradle system 100 to a base of a material handling vehicle 200 while it is in the upright position. In some embodiments, an auxiliary vehicle may be used to raise the base 202 of the material handling vehicle 200 off the ground surface 230 to facilitate attachment of the one or more sleighs to the material handling vehicle 200. Once the one or more sleighs of the cradle system are attached 1310, the material handling vehicle 200 is rotated 1320, for example by the auxiliary vehicle, toward the horizontal position. The rotation 1320 is done along the outer surface of the one or more sleighs. The outer surface of the sleighs supports the material handling vehicle 200 and, having a curved shape, facilitates rotation 1320 of the material handling vehicle 200.

With the material handling vehicle 200 rotated 1320 toward the horizontal position, at least one leg of the cradle system is attached 1330 to a mast 208 of the material handling vehicle 200. In some embodiments, the material handling vehicle 200 is rotated 1320 all the way to the horizontal position (e.g., mast 208 parallel with ground surface 230 or otherwise level) before the legs are attached. In an exemplary embodiment, the material handling vehicle 200 is rotated 1320 most of the way to (e.g. within a few degrees or inches of) the horizontal position, which may ease attachment 1330 of the one or more legs to the mast 208 by providing room to maneuver the legs about the mast 208. In yet other embodiments, the legs may be attached 1430 to the mast 208 before rotating 1320 the material handling vehicle 200 toward the horizontal position.

In some embodiments, with the one or more sleighs and legs of the cradle system 100 attached 1310, 1330, the material handling vehicle 200 is lowered 1340 to the horizontal position, such that the sleigh and the leg of the cradle system contact a ground surface, for example as shown in FIG. 8. In some embodiments, lowering 1340 the material handling vehicle 200 may include the auxiliary vehicle completing the rotation of the vehicle to the horizontal position and such that the one or more legs and sleighs of the cradle system 100 are in contact with the ground surface 230. In some embodiments of the rotation method 1300, the steps as described above may be reversed such that the material handling vehicle 200 is rotated from a horizontal position to a vertical position and the components of the cradle system 100 are removed from the material handling vehicle.

Figure 14:
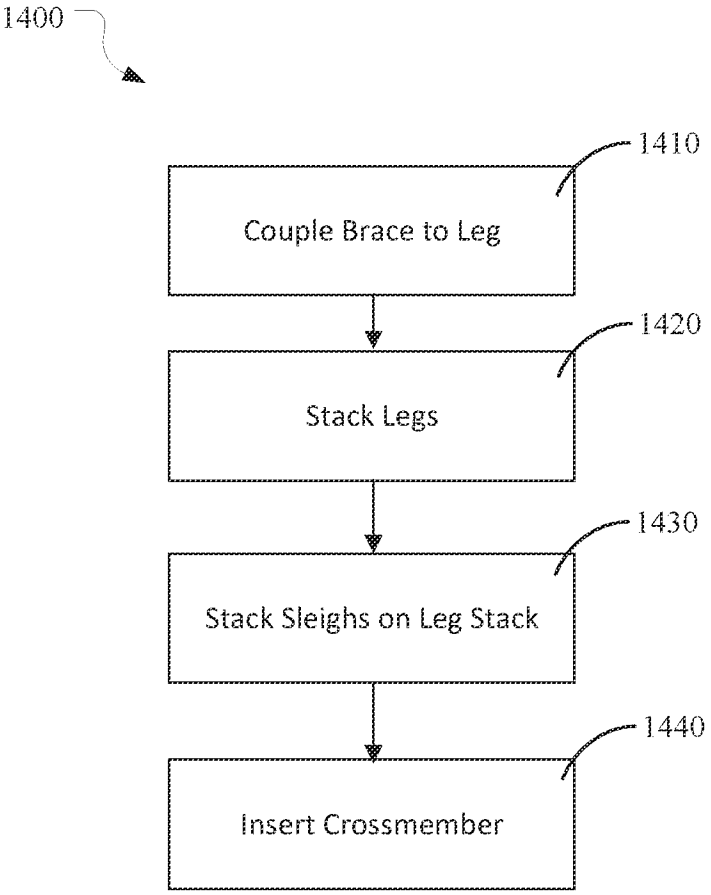
FIG. 14 illustrates a method for arranging the cradle system in a storage configuration, according to various aspects of the present disclosure.

Referring to FIG. 14, a method for nesting 1400 components of the cradle system 100 may comprise coupling various components of the cradle system 100 together for storage, transportation, or the like. At step 1410, the brace 170 may be coupled to one of the legs 106, 108, for example the first leg 106. In some embodiments, as described above, the leg may be received within the brace 170 and the brace 170 and leg may be fastened together. At step 1420, two or more legs may be stacked on each other. In some embodiments, stacking the legs 1420 may comprise coupling the other of the legs 106, 108, for example the second leg 108, with the assembly of the leg and brace from step 1410. In some embodiments, as described above, the other of the legs may be fastened to the leg and brace assembly, for example via the tabs 168. In some embodiments, where a step 1410 of coupling the brace to a leg is not performed, stacking the legs 1420 may comprise coupled the first leg 106 to the second leg 108.

At step 1430, one or more sleighs may be stacked on the one or more legs. In some embodiments, the first and second sleighs 102, 104 may be coupled to one of the legs in the assembly of step 1420. For example, the sleighs 102, 104 may be fastened to the second leg 108. In some embodiments, at step 1440, the crossmember 110 may be inserted into one of the legs 106, 108 and/or fastened to the leg. Accordingly, the nesting method 1400 may arrange the cradle system 100 into a storage configuration, as exemplified in FIGS. 5 and 6.

In addition, for certain types of vehicles there are training requirements imposed by various government agencies, laws, rules and regulations. For example, OSHA imposes a duty on employers to train and supervise operators of various types of material handling vehicles. Recertification every three years is also required. In certain instances, refresher training in relevant topics shall be provided to the operator when required. In all instances, the operator remains in control of the material handling vehicle during performance of any actions. Further, a warehouse manager remains in control of the fleet of material handling vehicles within the warehouse environment. The training of operators and supervision to be provided by warehouse managers requires among other things proper operational practices including among other things that an operator remain in control of the material handling vehicle, pay attention to the operating environment, and always look in the direction of travel.

While various spatial and directional terms, such as top, bottom, lower, mid, lateral, horizontal, vertical, front, and the like may be used to describe examples of the present disclosure, it is understood that such terms are merely used with respect to the orientations shown in the drawings. The orientations may be inverted, rotated, or otherwise changed, such that an upper portion is a lower portion, and vice versa, horizontal becomes vertical, and the like.

Within this specification embodiments have been described in a way which enables a clear and concise specification to be written, but it is intended and will be appreciated that embodiments may be variously combined or separated without parting from the invention. For example, it will be appreciated that all preferred features described herein are applicable to all aspects of the invention described herein.

Thus, while the invention has been described in connection with particular embodiments and examples, the invention is not necessarily so limited, and that numerous other embodiments, examples, uses, modifications and departures from the embodiments, examples and uses are intended to be encompassed by the claims attached hereto. The entire disclosure of each patent and publication cited herein is incorporated by reference, as if each such patent or publication were individually incorporated by reference herein.

Various features and advantages of the invention are set forth in the following claims.

We claim:

1. A cradle system for a material handling vehicle, comprising:

at least two legs configured to removably attach to a mast of the material handling vehicle; and at least two sleighs configured to removably attach to a base of the material handling vehicle, wherein:

the at least two legs and the at least two sleighs are configured to support the material handling vehicle above a surface when the material handling vehicle is in a horizontal position; and the at least two legs and the at least two sleighs are configured to be nested to combine into a singular unit for storage.

2. The cradle system of claim 1, further comprising a crossmember, wherein:

each of the at least two sleighs comprise an opening defined in a body of the sleigh, wherein:

the openings in the at least two sleighs are aligned and configured to receive the crossmember when the at least two sleighs are removably attached to the base of the material handling vehicle.

3. The cradle system of claim 1, further comprising a brace configured to removably attach to the at least two legs.

4. The cradle system of claim 2, further comprising a brace configured to removably attach to the at least two legs.

5. The cradle system of claim 1, wherein an outer surface of each of the at least two sleighs comprises a first portion, a second portion perpendicular to the first portion, and a third portion disposed between the first portion and the second portion, the third portion of the outer surface defining a curved shape.

6. The cradle system of claim 5, wherein the at least two legs and the at least two sleighs are configured to, when removably attached to the material handling vehicle:

support rotation of the material handling vehicle from an upright position to a horizontal position, wherein:

the second portions of the outer surfaces of the at least two sleighs contact the surface below the base of the material handling vehicle when the material handling vehicle is in an upright position; and the at least two legs and the first portions of the outer surfaces of the at least two sleighs contact the surface when the material handling vehicle is in the horizontal position.

7. The cradle system of claim 1, wherein at least one of the at least two sleighs is configured to receive a fork of the material handling vehicle.

8. The cradle system of claim 5, wherein each of the at least two legs comprises a bracket at a first end of each leg, wherein:

each bracket is configured to removably couple the leg to the mast; and each bracket comprises an extension piece, wherein the extension piece is perpendicular to the bracket and is configured to retain a movable portion of the mast.

9. The cradle system of claim 1, wherein:

a first leg of the at least two legs is positioned on a second leg of the at least two legs;

the at least two sleighs are positioned on the first leg; and each of the first leg, second leg, and at least two sleighs are coupled to form the singular unit, wherein the first leg is coupled to the second leg, and the at least two sleighs are coupled to the first leg.

10. The cradle system of claim 2, wherein:

a first leg of the at least two legs is positioned on a second leg of the at least two legs;

the crossmember is inserted into one of the at least two legs;

the at least two sleighs are positioned on the first leg; and each of the first leg, second leg, and at least two sleighs are coupled to form the singular unit, wherein the first leg is coupled to the second leg, and the at least two sleighs are coupled to the first leg.

11. The cradle system of claim 3, wherein:

a second leg of the at least two legs is received within the brace;

a first leg of the at least two legs is positioned on the second leg received within the brace;

the at least two sleighs are positioned on the first leg; and each of the first leg, second leg, brace, and at least two sleighs are coupled to form the singular unit, wherein the second leg is coupled with the brace, the first leg is coupled to the second leg, and the at least two sleighs are coupled to the first leg.

12. The cradle system of claim 8, wherein each of the at least two legs comprise a roller.

13. The cradle system of claim 12, wherein each of the at least two sleighs comprise a pad disposed on the first portion of the outer surface of said sleigh.

14. A cradle system for a material handling vehicle, comprising:

at least two legs configured to removably attach to a mast of the material handling vehicle;

at least two sleighs configured to removably attach to a base of the material handling vehicle, wherein:

the at least two legs and the at least two sleighs are configured to support the material handling vehicle above a surface when the material handling vehicle is in a horizontal position;

the at least two legs and the at least two sleighs are configured to combine into a singular unit, and each of the at least two sleighs comprise an opening defined in a body of the sleigh, wherein:

the openings in the at least two sleighs are aligned and configured to receive a crossmember when the at least two sleighs are removably attached to the base of the material handling vehicle.

15. The cradle system of claim 14, wherein an outer surface of each of the at least two sleighs comprises a first portion, a second portion perpendicular to the first portion, and a third portion disposed between the first portion and the second portion, the third portion of the outer surface defining a curved shape.

16. The cradle system of claim 15, wherein the at least two legs and the at least two sleighs are configured to, when removably attached to the material handling vehicle:

support rotation of the material handling vehicle from an upright position to a horizontal position, wherein:

the second portions of the outer surfaces of the at least two sleighs contact the surface below the base of the material handling vehicle when the material handling vehicle is in an upright position; and the at least two legs and the first portions of the outer surfaces of the at least two sleighs contact the surface when the material handling vehicle is in the horizontal position.

17. A cradle system for a material handling vehicle, comprising:

at least two legs configured to removably attach to a mast of the material handling vehicle; and at least two sleighs configured to removably attach to a base of the material handling vehicle, wherein:

the at least two legs and the at least two sleighs are configured to support the material handling vehicle above a surface when the material handling vehicle is in a horizontal position;

the at least two legs and the at least two sleighs are configured to combine into a singular unit, and at least one of the at least two sleighs is configured to receive a fork of the material handling vehicle.

18. The cradle system of claim 17, further comprising a crossmember, wherein:

each of the at least two sleighs comprise an opening defined in a body of the sleigh, wherein:

the openings in the at least two sleighs are aligned and configured to receive the crossmember when the at least two sleighs are removably attached to the base of the material handling vehicle.

19. A cradle system for a material handling vehicle, comprising:

at least two legs configured to removably attach to a mast of the material handling vehicle; and at least two sleighs configured to removably attach to a base of the material handling vehicle, wherein:

the at least two legs and the at least two sleighs are configured to support the material handling vehicle above a surface when the material handling vehicle is in a horizontal position;

the at least two legs and the at least two sleighs are configured to combine into a singular unit;

a first leg of the at least two legs is positioned on a second leg of the at least two legs;

the at least two sleighs are positioned on the first leg; and each of the first leg, second leg, and at least two sleighs are coupled to form the singular unit, wherein the first leg is coupled to the second leg, and the at least two sleighs are coupled to the first leg.

20. The cradle system of claim 19, further comprising a brace configured to removably attach to the at least two legs.

* * * * *